United States Patent [19]

Barron

[11] 3,958,430

[45] May 25, 1976

[54] ORNAMENTAL EAR CLIP WITH RETAINING MEANS PRESSING AGAINST THE EAR AND HEAD

[75] Inventor: Margaret Barron, Bronxville, N.Y.

[73] Assignee: Lawrence Peska Associates, Inc., New York, N.Y. ; a part interest

[22] Filed: June 18, 1975

[21] Appl. No.: 588,040

[52] U.S. Cl. ..... 63/14 A; 63/14 G

[51] Int. Cl.[2] ..... A44C 7/00

[58] Field of Search ..... 63/14 A, 14 G, 14 R

[56] References Cited

UNITED STATES PATENTS

| | | | |
|---|---|---|---|
| 2,498,748 | 2/1950 | Barron | 63/14 G |
| 2,526,087 | 10/1950 | Schoolman et al. | 63/14 A |
| D160,246 | 9/1950 | Brandano | 63/14 A UX |

FOREIGN PATENTS OR APPLICATIONS

| | | | |
|---|---|---|---|
| 64,074 | 5/1955 | France | 63/14 A |

*Primary Examiner*—F. Barry Shay

*Attorney, Agent, or Firm*—Jack D. Slobod

[57] ABSTRACT

An ornamental ear clip includes a decorative portion extending from the helix to the lobe of an ear. The decorative portion is shaped to conform to the free portion of the ear. A pair of resilient wire legs project from the decorative portion to the back side of the ear. One leg is urged against the rear side of the anti-helix of the ear and a second leg is urged along the intersection of the ear with the side of the head.

2 Claims, 4 Drawing Figures

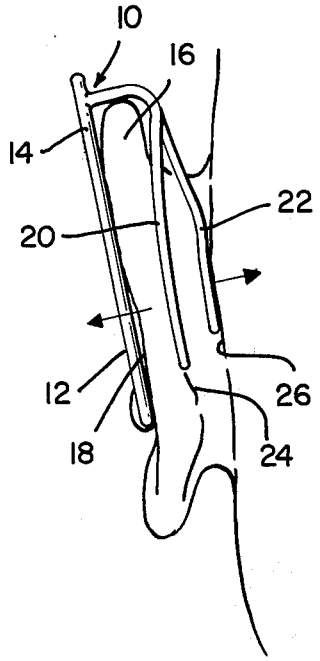
FIG. 1
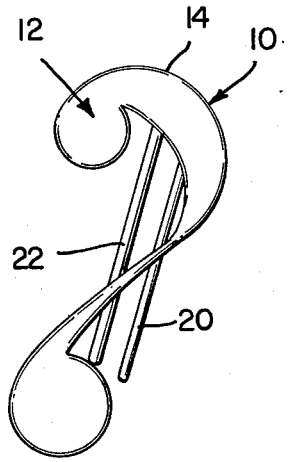
FIG. 4
FIG. 2
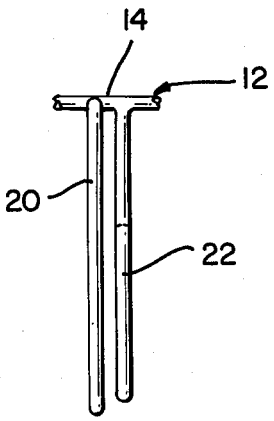
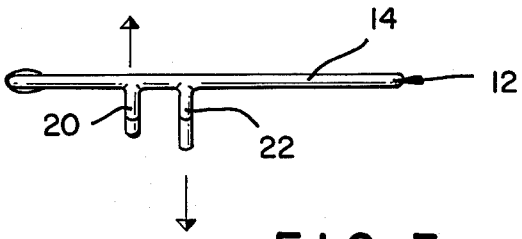
FIG. 3

ORNAMENTAL EAR CLIP WITH RETAINING MEANS PRESSING AGAINST THE EAR AND HEAD

FIELD OF THE INVENTION

The present invention relates generally to decorative ear clips which are worn over the external face of the ear, including the helix. In its particular aspects, the present invention relates to the provision of a pair of oppositely deflected resilient legs for mounting the clip on the ear.

BACKGROUND OF THE INVENTION

The present invention is an improvement of the ornamental ear clip disclosed and claimed in U.S. Pat. No. 2,498,748 issued to me Feb. 28, 1950. I have found that the mounting for the ornamental ear clip disclosed in my previous patent was not always effective in retaining the clip on the ear.

OBJECTS OF THE INVENTION

It is an object of the present invention to provide a mounting means for an earclip of the type which extends from the helix to the lobe of the ear, which mounting will hold the clip in place on the ear in a positive manner.

It is a further object of the present invention to provide a mounting for an ear clip which will secure the clip to differently sized ears.

SUMMARY OF THE INVENTION

Briefly, the aforementioned and other objects of the present invention are satisfied by providing an ear clip of the type which extends from the helix to the lobe of the ear with a pair of resilient mounting legs. One leg is shaped to conform to the rear side of the ear and the other leg is shaped to conform to the intersection of the ear with the back of the head. The two legs are formed angularly spaced apart so that they must be deflected toward each other when placed on the ear thus providing an effective mounting able to conform to different sizes of ears.

Other objects, features and advantages of the present invention will become apparent upon perusal of the following detailed description of the preferred embodiment thereof when taken in conjunction with the appended drawing wherein:

FIG. 1 is a side view of the ornamental earclip of the present invention in place on an ear as viewed from the rear of a head;

FIG. 2 is a partial view of the back of the earclip in FIG. 1;

FIG. 3 is a top view of the earclip of FIG. 1; and

FIG. 4 is a front view of the earclip of FIG. 1.

DETAILED DESCRIPTION

Referring to FIGS. 1 through 4 of the drawing, the ornamental earclip 10 of the present invention comprises a decorative member having an ornamental front face 12, generally in the shape of a question mark which includes an outer periphery 14 passing around the helix or rim of the ear 16 and terminating at the ear lobe.

The improvement taught by the present invention relates to the mounting means for holding ornamental front face 12 of the decorative member in position flatwise on the front face 18 of ear 16. In accordance with the present invention a pair of resilient wire legs 20 and 22 are projected in spaced apart relationship from the top of periphery 14 and over the top of ear 16. The legs 20 and 22 are first directed perpendicular to front face 12 and then are bent downward around the back side of the ear. The legs 20 and 22 in addition to being spaced along periphery 14 are angularly spaced apart. Furthermore, the legs 20 and 22 are formed in arcuate shapes so that leg 20 lies along the antihelix on the rear side 24 of the ear and leg 22 lies against the back of the head along the curve of intersection 26 of the ear therewith.

The legs 20 and 22, being resilient, are formed so that the legs are deflected toward each other when placed between the rear side 24 of the ear and the back side of the head to provide opposed forces capturing ear clip 10 in place on ear 16. The required deflection of the legs allows the legs 20 and 22 to conform to ears of different sizes.

Having described the preferred embodiment of the present invention in detail, it should be apparent that various modifications, additions and omissions in the details thereof are possible within the intended spirit and scope of the invention. Accordingly, the following claims define the invention.

What is claimed is:

1. An ornamental earclip device for attaching against the front face of an external ear of a wearer comprising a decorative member sized and proportioned to extend from the top of the helix to the lobe of the ear in a position resting flatwise on said front face, mounting means attached to said decorative member for holding it in said position comprising a first leg extending from the top of said decorative member for extending over the top of the helix and down along the rear side of the ear, said first leg being bent to conform to the rear side of the antihelix of the ear and a second leg extending from the top of said decorative member for extending over the top of the helix and down along the intersection of said ear with the back side of the head, said legs being arranged to press respectively against the ear and head to support the earclip in said position on the wearer's ear.

2. The device of claim 1 wherein said first and second legs are resilient and where said legs are formed to be deflected in opposed directions when in place on an ear.

* * * * *